US006860760B2

(12) United States Patent
Endo et al.

(10) Patent No.: US 6,860,760 B2
(45) Date of Patent: Mar. 1, 2005

(54) CONNECTOR

(75) Inventors: Takayoshi Endo, Haibara-gun (JP); Kimihiro Abe, Haibara-gun (JP); Isao Kameyama, Haibara-gun (JP); Yasuo Yoshiura, Shinagawa-ku (JP)

(73) Assignees: Yazaki Corporation, Tokyo (JP); SMK Corporation, Tokyo (JP)

( * ) Notice: Subject to any disclaimer, the term of this patent is extended or adjusted under 35 U.S.C. 154(b) by 0 days.

(21) Appl. No.: 10/720,160

(22) Filed: Nov. 25, 2003

(65) Prior Publication Data

US 2004/0121649 A1 Jun. 24, 2004

(30) Foreign Application Priority Data

Dec. 19, 2002 (JP) ..... 2002-367612

(51) Int. Cl.[7] ..... H01R 9/05
(52) U.S. Cl. ..... 439/578
(58) Field of Search ..... 439/578, 595, 439/752.5, 585, 610, 877

(56) References Cited

U.S. PATENT DOCUMENTS 5,975,950 A * 11/1999 Yamaguchi ..... 439/585
6,210,223 B1 * 4/2001 Aoyama et al. ..... 439/585
6,254,430 B1 * 7/2001 Endo et al. ..... 439/578
6,554,644 B2 * 4/2003 Koide ..... 439/585
6,623,313 B1 * 9/2003 Ichida et al. ..... 439/752.5
6,702,614 B2 * 3/2004 Nakamura et al. ..... 439/595

* cited by examiner

*Primary Examiner*—Ross Gushi
*Assistant Examiner*—Phuongchi Nguyen
(74) *Attorney, Agent, or Firm*—Westerman, Hattori, Daniels & Adrian, LLP

(57) ABSTRACT

A pair of engaging holes 15 are formed in side wall portions of the plug pin 1 and a pair of engaging beams 35 are formed on side wall portions of an insulating housing 3, the engaging beams 35 being pushed by an external contact 5 and moving toward a pin inserting hole 31 when the insulating housing 3 with the plug pin 1 press-fitted therein is inserted into the external contact 5. As a result, a pair of retaining pawls 37 are put in engagement with the engaging holes 15, whereby the plug pin 1 and the insulating housing 3 are fixed to each other. Since the plug pin 1 and the insulating housing 3 are fixed together by both press-fit engagement of the plug pin 1 into the insulating housing 3 and engagement of the retaining pawls 37 with the engaging holes 15, the strength of the fixing is enhanced.

5 Claims, 20 Drawing Sheets

CONNECTOR

BACKGROUND OF THE INVENTION

The present invention relates to a connector comprising a central contact, an insulating housing having a contact inserting hole into which the central contact is press-fitted, and an external contact adapted to engage with the insulating housing by insertion therein of the insulating housing with the central contract press-fitted therein. For example, the present invention is concerned with an automobile antenna plug connected to an end portion of a coaxial cable.

Heretofore, as this type of a connector there has been known such a coaxial connector as shown in FIGS. 1A to 1C and FIGS. 2 and 3, which connector is disclosed, for example, in Japanese Patent No. 3059432 issued Jul. 4, 2000.

More particularly, such a plug pin 100 as shown in FIG. 1A, which serves as a central contact, is press-fitted into a cylindrical hollow portion 104 from behind an insulating housing 102, as shown in FIG. 1B. At this time, a pair of retaining projections 106 and a pair of retaining projections 108 of the plug pin 100 bite into engagement with an engaging rib (not shown) projecting from an inner wall surface of the insulating housing 102, whereby the plug pin 100 is fixed within the cylindrical hollow portion 104 of the insulating housing 102.

Then, an assembly 110 thus obtained is inserted into an external contact 112, as shown in FIG. 1C. When an engaging lance 114 of the external contact 112 gets over an engaging stepped portion 116 of the insulating housing 102, both come into engagement with each other as in FIG. 3 and the external contact 112 is fixed to the outside of the insulating housing 102.

Next, as shown in FIG. 2, a braided conductor (shielded conductor) 73 of a coaxial cable 7 and a central conductor 71 are exposed and the central conductor 71 is connected to a connecting portion 120 of the plug pin 100, thereafter, the braided conductor 73 is connected to the external contact 112.

The connection of the central conductor 71 to the connecting portion 120 is performed in the following manner.

The central conductor 71 of the coaxial cable 7 is disposed above an engaged portion between a first engaging contact piece 122 and a pair of second engaging contact pieces 124 of the plug pin 100, then the first and second engaging contact pieces 122, 124 are pushed and expanded using a jig (not shown) and the central conductor 71 is conducted into concaves of the second engaging contact pieces 124, followed by removal of the jig, whereby, as shown in FIG. 3, the central conductor 71 is held grippingly between the first and second engaging contact pieces 122, 124 and is connected electrically to the plug pin 100.

Connection of the braided conductor 73 to the external contact 112 is performed in the following manner.

A pair of inner compression-bonding pieces 126 of the external contact 112 are inserted between an internal insulator 72 and the braided conductor 73 of the coaxial cable 7 and then a pair of outer compression-bonding pieces 128 are caulked, whereby the braided conductor 73 and the external contact 112 are integrally fixed and connected to each other electrically, as shown in FIG. 3.

Then, a pair of coating compression-bonding pieces 130 are caulked on an outer insulating coating 74 of the coaxial cable 7 to fix the whole of the coaxial cable 7 to the external contact 112, as shown in FIG. 3.

The numeral 132 denotes a cover piece which is bent to cover the connecting portion 120 from above, numeral 134 denotes an insulating cover for covering an outer periphery surface of the external contact 112, numeral 136 denotes an insulating cap which is fitted on the coaxial cable 7 beforehand and brought into engagement with the insulating cover, and numeral 138 denotes a contact tongue piece provided in a pair which is projected from a window hole formed in the insulating cap and comes into contact with an earth terminal of a mating connector.

However, in the conventional connector shown in FIGS. 1A to 1C and FIGS. 2 and 3, the plug pin 100 is press-fitted into the cylindrical hollow portion 104 of the insulating housing 102 and its retaining projections 106 and 108 are merely allowed to bite into engagement with the engaging rib projecting from the inner wall surface of the insulating housing 102 to retain the plug pin. Thus, there has been the problem that the fixing strength between the plug pin 100 and the insulating housing 102 is not sufficient and that therefore the plug pin 100 is apt to come off from the insulating housing 102.

Particularly, in a standard type connector to which a relatively thick coaxial cable is connected, a base end-side outer periphery portion of a semispherical tip of the plug pin is formed in the shape of an annular recess to increase the holding force at the time of fitting with a mating connector (e.g., an automobile antenna socket), so that a relatively large tensile force is exerted on the plug pin, thus giving rise to the problem that the plug pin is apt to come off from the insulating housing.

SUMMARY OF THE INVENTION

It is a first object of the present invention to make a fixing strength between a central contact and an insulating housing higher than that in the prior art in a connector comprising the central contact, the insulating housing, the insulating housing having a contact inserting hole for press-fit therein of the central contact, and an external contact adapted to engage with the insulating housing by insertion therein of the insulating housing with the central contact press-fitted therein, the insulating housing being formed in a generally cylindrical shape. An engaging hole is formed in a side wall of the central contact, while a retaining beam is formed on a side wall of the insulating housing, with a retaining pawl being formed in part of the retaining beam. When the insulating housing with the central contact press-fitted therein is inserted into the external contact, the retaining beam is pushed by the external contact and moves toward the contact inserting hole and the retaining pawl comes into engagement with the engaging hole, whereby the central contact and the insulating housing are fixed together. Thus, the central contact and the insulating housing are fixed together by both press-fit engagement of the central contact with the contact inserting hole and engagement of the engaging pawl with the engaging hole. Consequently, the fixing strength between the central contact and the insulating housing can be enhanced in comparison with the prior art in which both are fixed together by press-fitting of the central contact into the contact inserting hole.

It is a second object of the present invention to enhance the fixing strength between the central contact and the insulating housing in a well-balanced state without making the structure of the central contact and that of the insulating housing so complicated. A pair of engaging holes are formed in opposed side wall portions of the central contact, a pair of retaining beams are formed in opposed side wall portions of the insulating housing, and retaining pawls are projected respectively from front ends of the retaining beams. When the insulating housing with the central contact press-fitted therein is inserted into the external contact, the pair of retaining beams are pushed by the external contact and move toward the contact inserting hole, while the pair of engaging pawls are engaged with the corresponding pair of engaging holes, whereby the central contact and the insulating housing are fixed together. With this construction, it is possible to enhance the fixing strength between the central contact and the insulating housing in a well-balanced state.

It is a third object of the present invention to make the fixing strength between the central contact and the insulating housing still higher in a well-balanced state without making the structure of the central contact and that of the insulating housing so complicated. An engaging rib of a rectangular parallelepiped shape which is elongated along a central axis of the contact inserting hole is projected from an inner wall surface of the contact inserting hole of the insulating housing at a position almost equidistant from a pair of retaining beams, an engaging notch is formed on a base end side of the central contact for engagement with the engaging rib at the time of press-fitting of the central contact into the contact inserting hole, and a pair of retaining projections adapted to bite into engagement with the engaging rib at the time of press-fitting of the central contact into the contact inserting hole are projected from opposed inside edges of the engaging notch. According to this construction, it is possible to make the fixing strength between the central contact and the insulating housing still higher in a well-balanced state.

It is a fourth object of the present invention to enhance the fixing strength between the insulating housing and the external contact in a well balanced state without making the structure of the insulating housing and that of the external contact so complicated. A pair of engaging lances are formed in opposed side wall portions of the external contact by cutting the side walls and raising the cut portions, while a pair of engaging stepped portions for engagement with the engaging lances at the time of insertion of the insulating housing into the external contact are formed on the side wall of the insulating housing. When the central contact and the insulating housing are fixed together by inserting the insulating housing into the external contact, the pair of engaging lances come into engagement with the corresponding engaging stepped portions. According to this construction, the fixing strength between the insulating housing and the external contact can be enhanced in a well-balanced state.

BRIEF DESCRIPTION OF THE DRAWINGS

FIGS. 1A to 1C illustrate a conventional connector, of which FIG. 1A is a plan view of a plug pin 100, FIG. 1B is an explanatory diagram showing a process of press-fitting the plug pin 100 into a cylindrical hollow portion 104 of an insulating housing 102, and FIG. 1C is an explanatory diagram showing a process of inserting the insulating housing 102 with the plug pin 100 press-fitted therein (i.e., an assembly 110) into an external contact 112;

FIGS. 27A and 27B illustrate a connector assembling process, of which FIG. 27A illustrates a step of press-fitting a plug pin 1 into a pin inserting hole 31 of the insulating housing 3 and FIG. 27B illustrates a step of inserting the insulating housing 3 with the plug pin 1 press-fitted therein into the external contact 5; and FIGS. 28A and 28B illustrate a process of connecting a central conductor 71 of a coaxial cable 7 to a connecting portion 12 of the connector, of which FIG. 28A illustrates a step of conducting the central conductor 71 to between a first engaging contact piece 22 and a pair of second engaging contact pieces 23 with use of a jig 8 and FIG. 28B illustrates a removed state of the jig 8 after conducting the central conductor 71 to between the first and second engaging contact pieces 22, 23.

DETAILED DESCRIPTION OF THE INVENTION

Figures 1A, 1B, 1C:
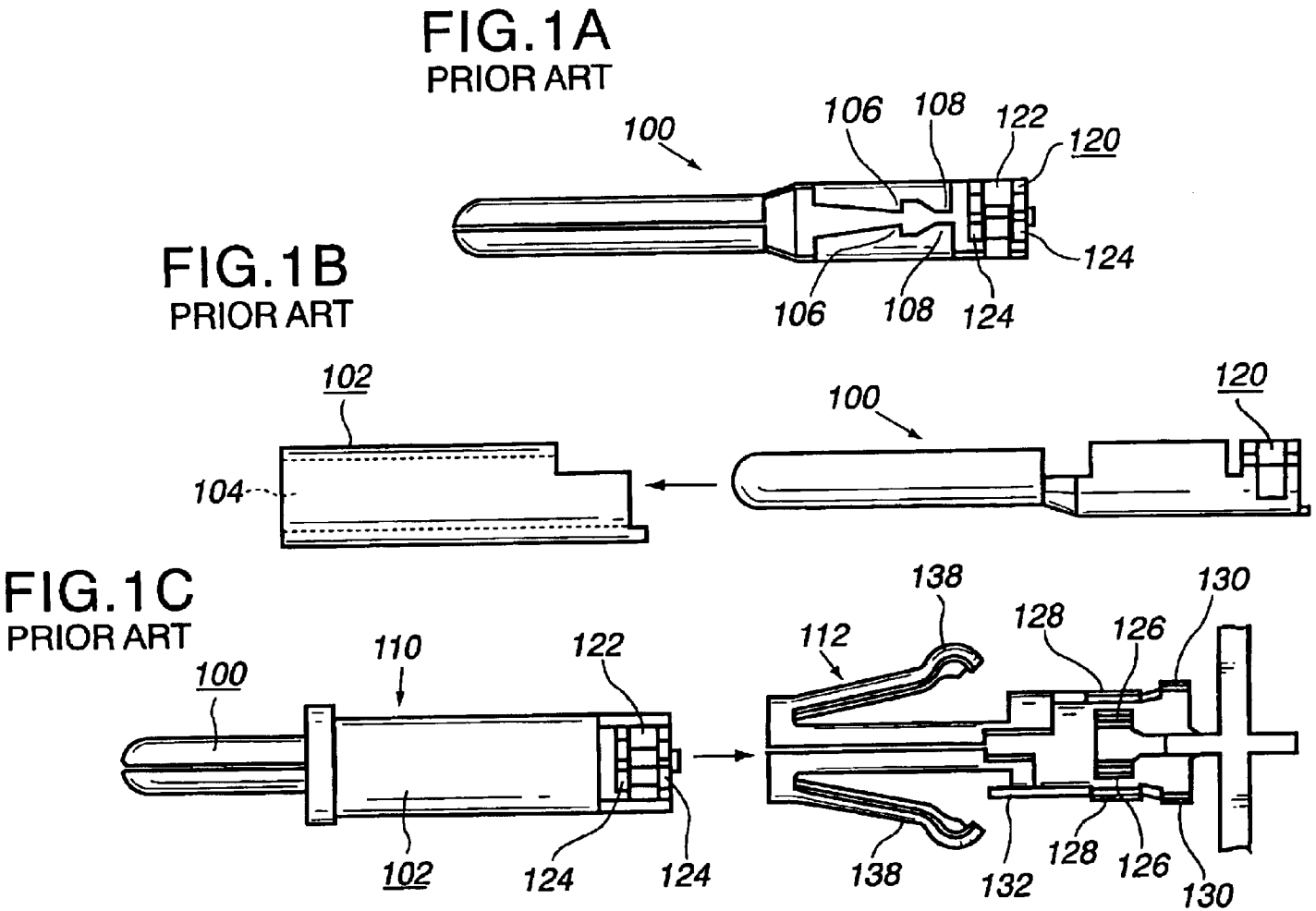
FIG. 1A PRIOR ART
FIG. 1B PRIOR ART
FIG. 1C PRIOR ART
Figure 2:
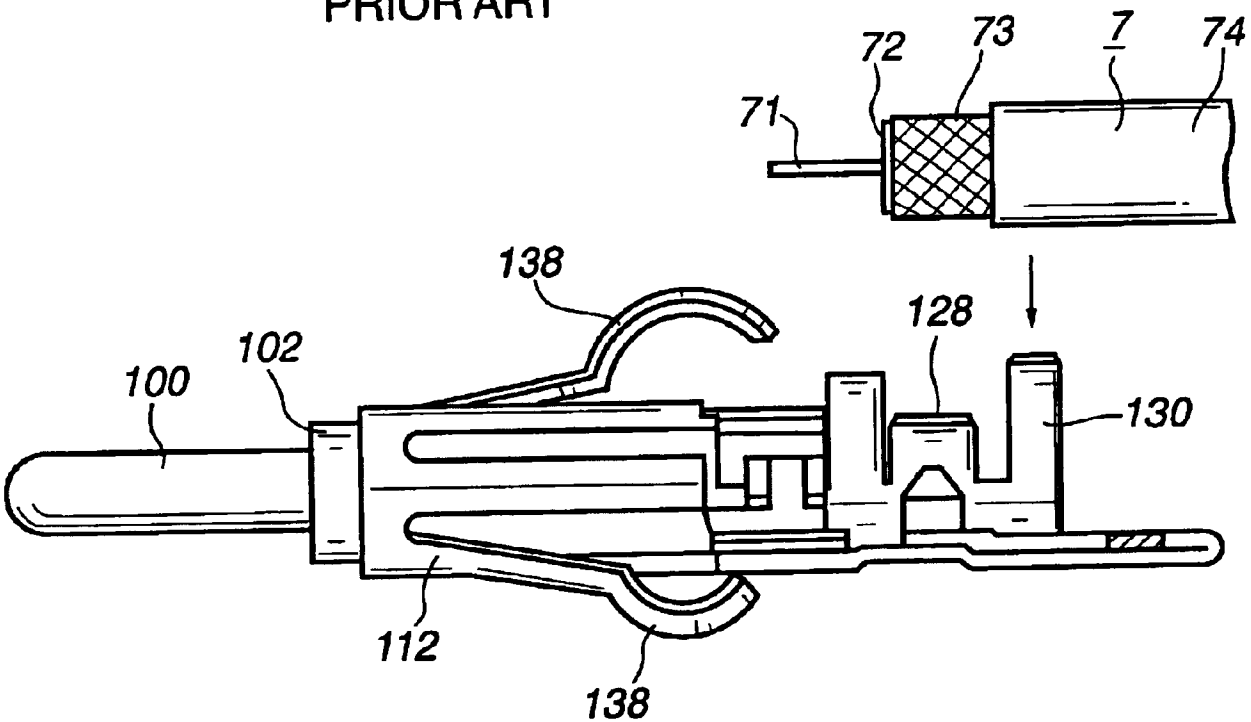
FIG.2 PRIOR ART
FIG. 2 is an explanatory diagram showing a process of connecting a coaxial cable 7 to a connector which has been assembled in FIGS. 1A to 1C.
Figure 3:
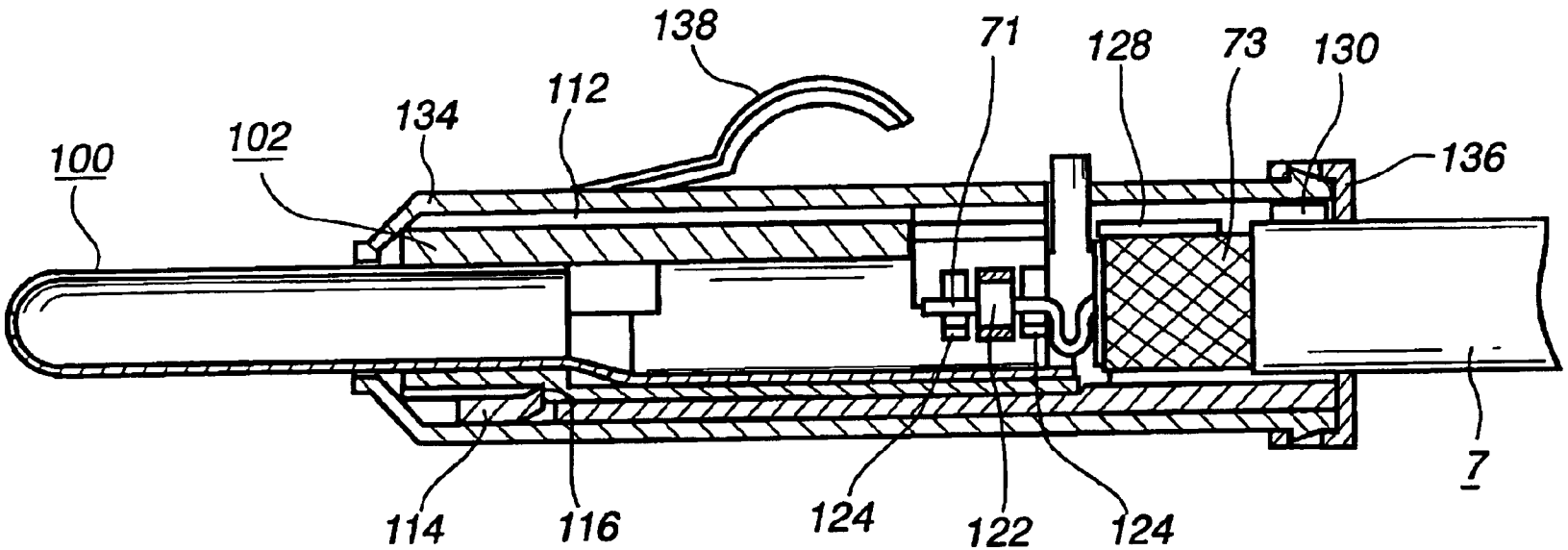
FIG.3 PRIOR ART
FIG. 3 is a sectional view showing the connector with the coaxial cable 7 connected thereto.
Figure 4:
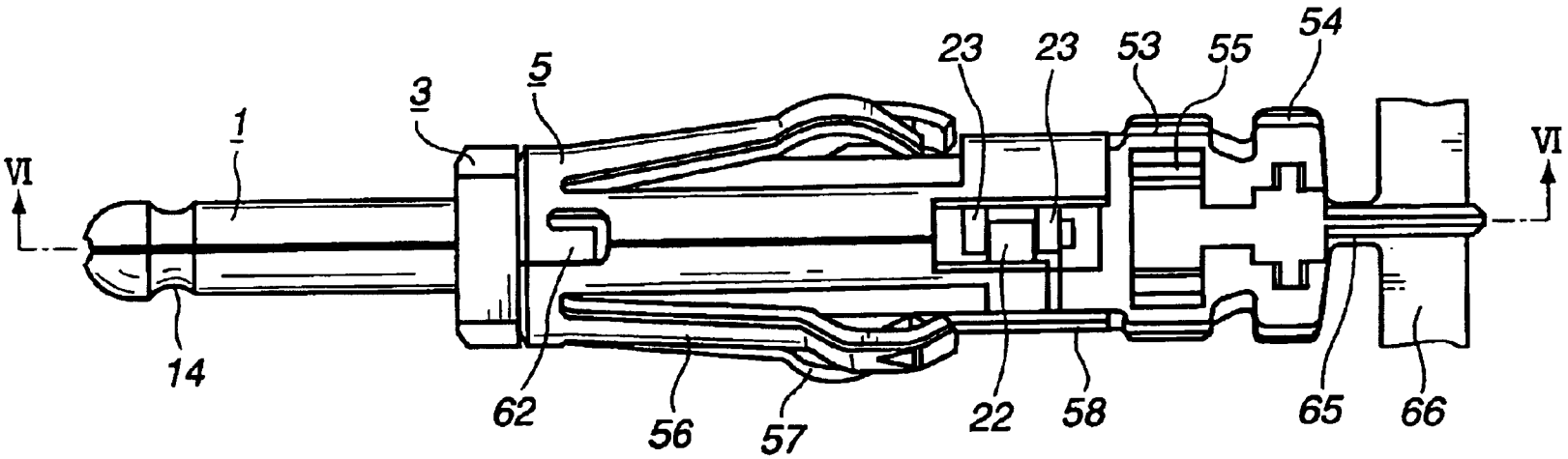
FIG. 4 is a front view of a connector according to an embodiment of the present invention.
Figure 5:
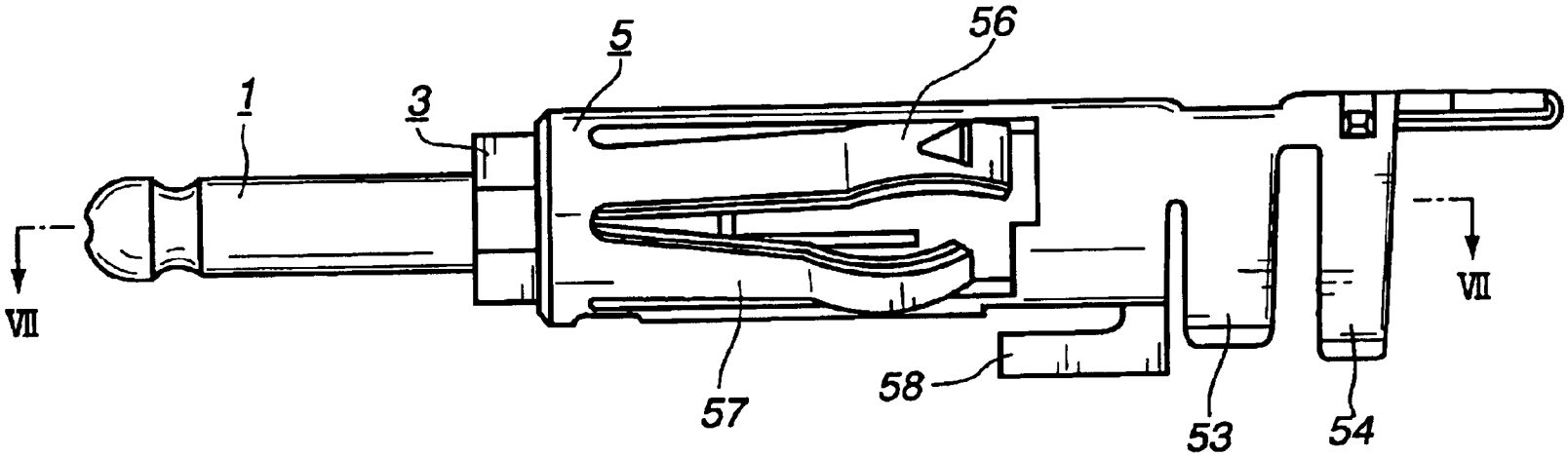
FIG. 5 is a plan view of FIG. 4.

An embodiment of the present invention will be described hereinunder with reference to the accompanying drawings.

FIGS. 4 to 9 illustrate an entire construction of a connector (e.g., an automobile antenna plug) embodying the present invention. In these figures, the numeral 1 denotes a plug pin as an example of a central contact, numeral 3 denotes an insulating housing, and numeral 5 denotes an external contact.

The plug pin 1 is formed by punching and bending a conductive metallic sheet. As shown in FIGS. 10 to 15, the plug pin 1 is composed of a generally cylindrical pin body 11 and a connecting portion 12 which is integrally contiguous to a base end side (right side in FIG. 4) of the pin body 11.

An upper portion of the pin body 11 is separated by a slit 13 formed in parallel with an axial direction of the pin body.

A front end side (left side in FIG. 10) of the pin body 11 is formed in a generally semispherical shape and a base end-side outer periphery portion 14 of the semispherical front end is formed in the shape of an annular recess to enhance a holding force at the time of fitting with a mating connector.

A pair of engaging holes 15 are formed respectively in side wall portions of the pin body 11 which side wall portions are opposed to each other on both sides of the slit 13.

On the base end side of the pin body 11 there is formed an engaging notch 16 by expanding the slit 13 halfway in its width direction, and a pair of retaining projections 17 are formed on opposed inside edges of the engaging notch 16.

The connecting portion 12 is composed of a contact piece body 21 having a generally semicircular cross section perpendicular to the axial direction of the plug pin 1 and a first engaging contact piece 22 and a pair of second engaging contact pieces 23 extending from a part of a front edge of the contact piece body 21.

Figure 13:
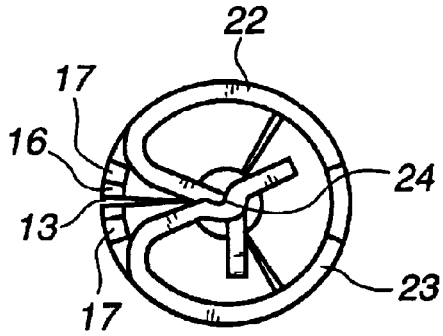
FIG. 13 is an enlarged right side view of FIG. 10.
Figure 14:
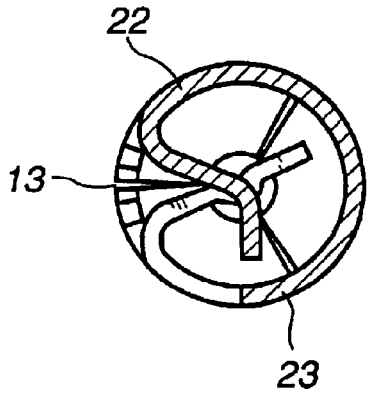
FIG. 14 is a sectional view taken on line XIV—XIV of FIG. 10.
Figure 15:
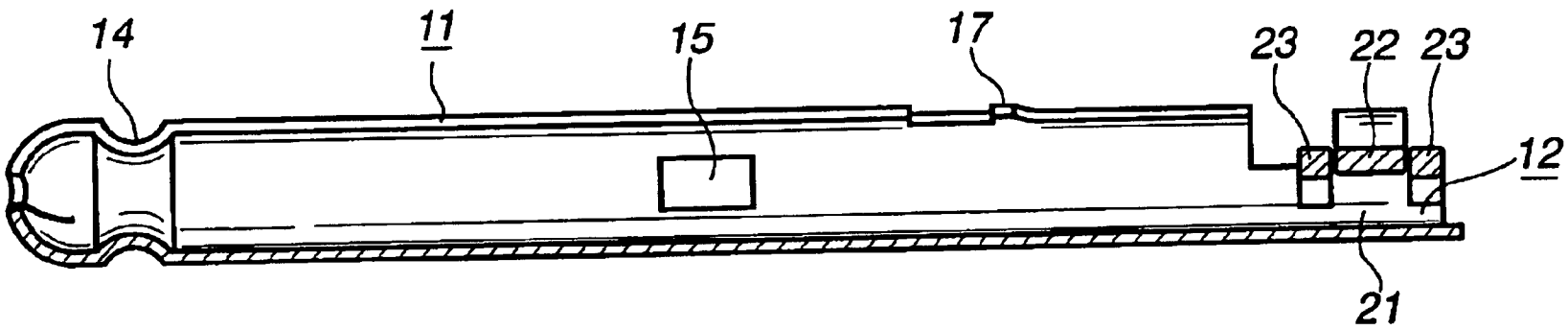
FIG. 15 is a sectional view taken on line XV—XV of FIG. 10.
Figure 16:
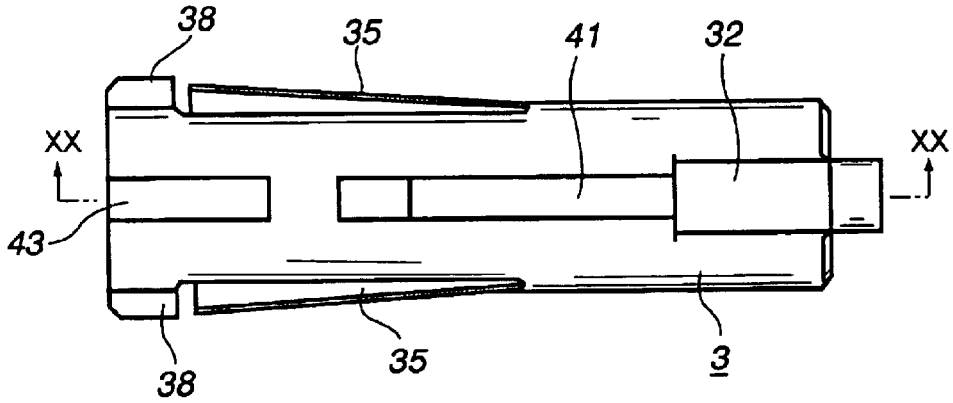
FIG. 16 is a front view of an insulating housing 3 shown in FIGS. 4 to 9.
Figure 17:
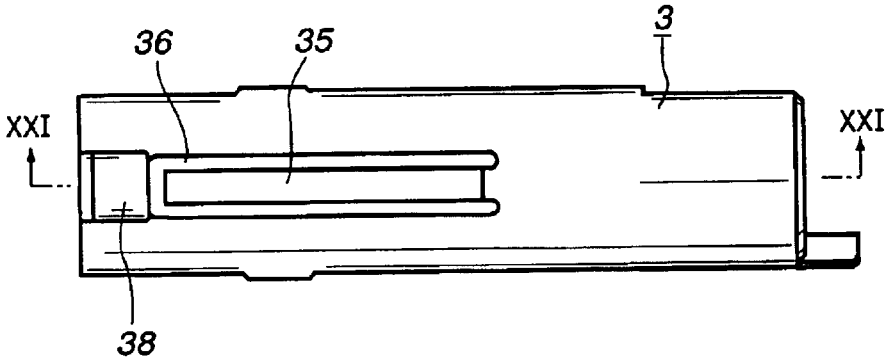
FIG. 17 is a bottom view of FIG. 16.
Figure 18:
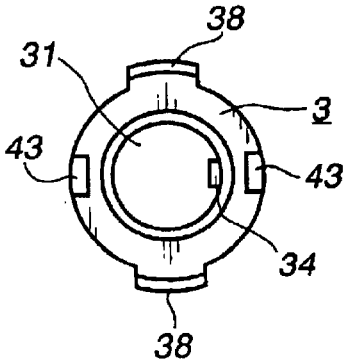
FIG. 18 is a left side view of FIG. 16.
Figure 19:
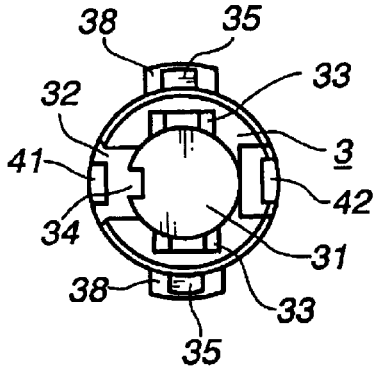
FIG. 19 is a right side view of FIG. 16.
Figure 20:
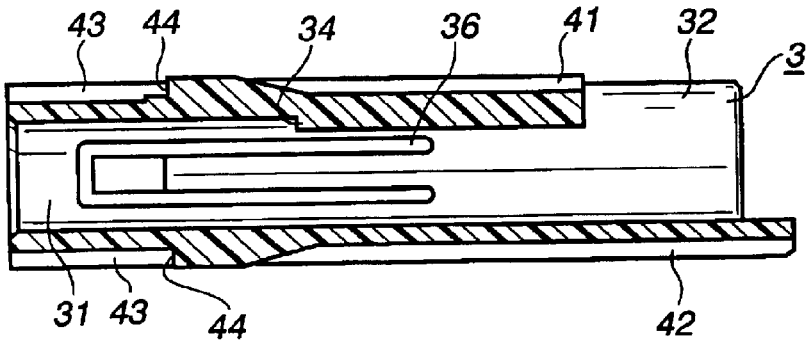
FIG. 20 is a sectional view taken on line XX—XX of FIG. 16.
Figure 21:
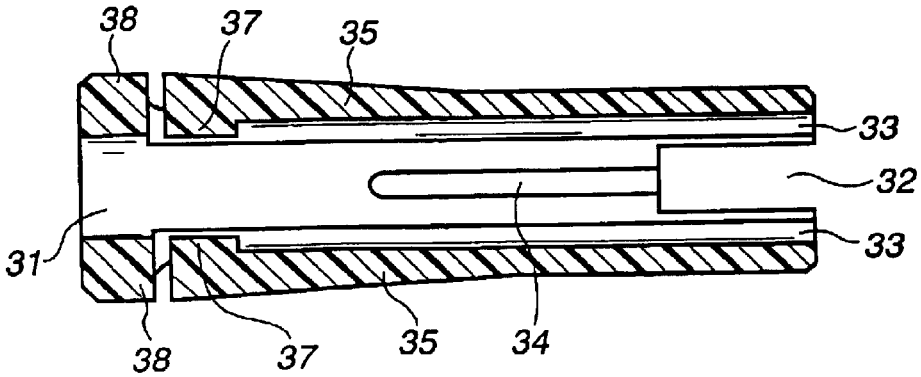
FIG. 21 is a sectional view taken on line XXI—XXI of FIG. 17.
Figure 22:
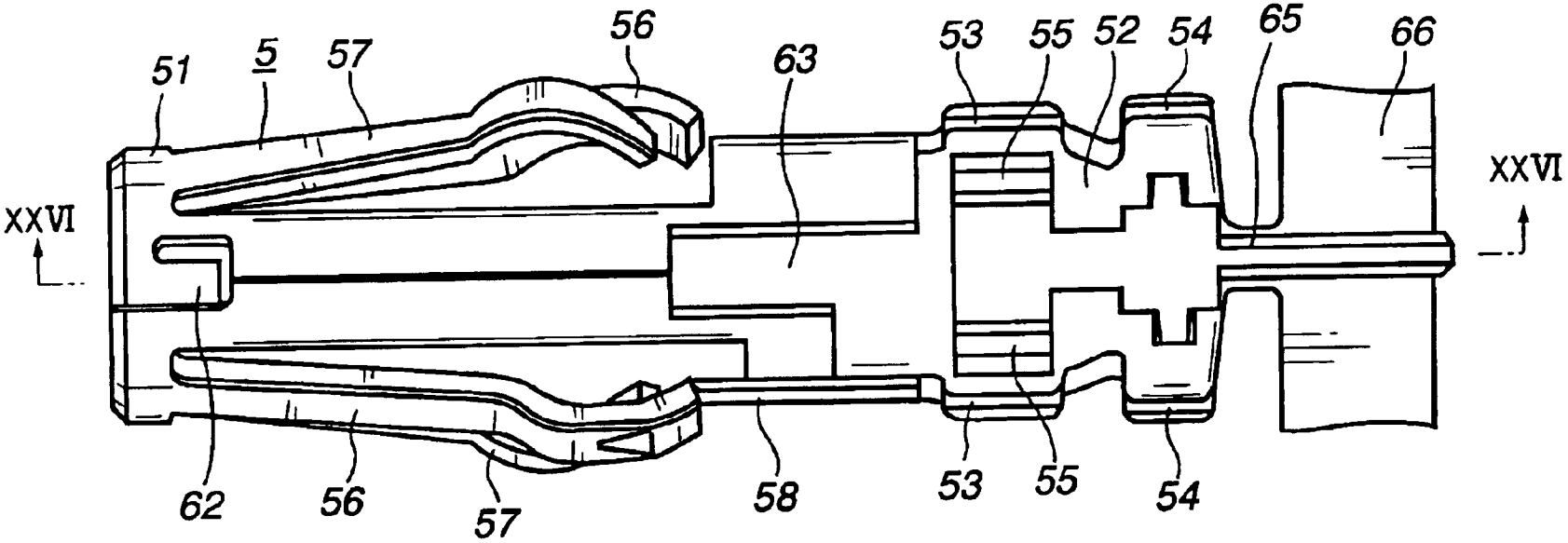
FIG. 22 is a front view of an external contact 5 shown in FIGS. 4 to 9.
Figure 23:
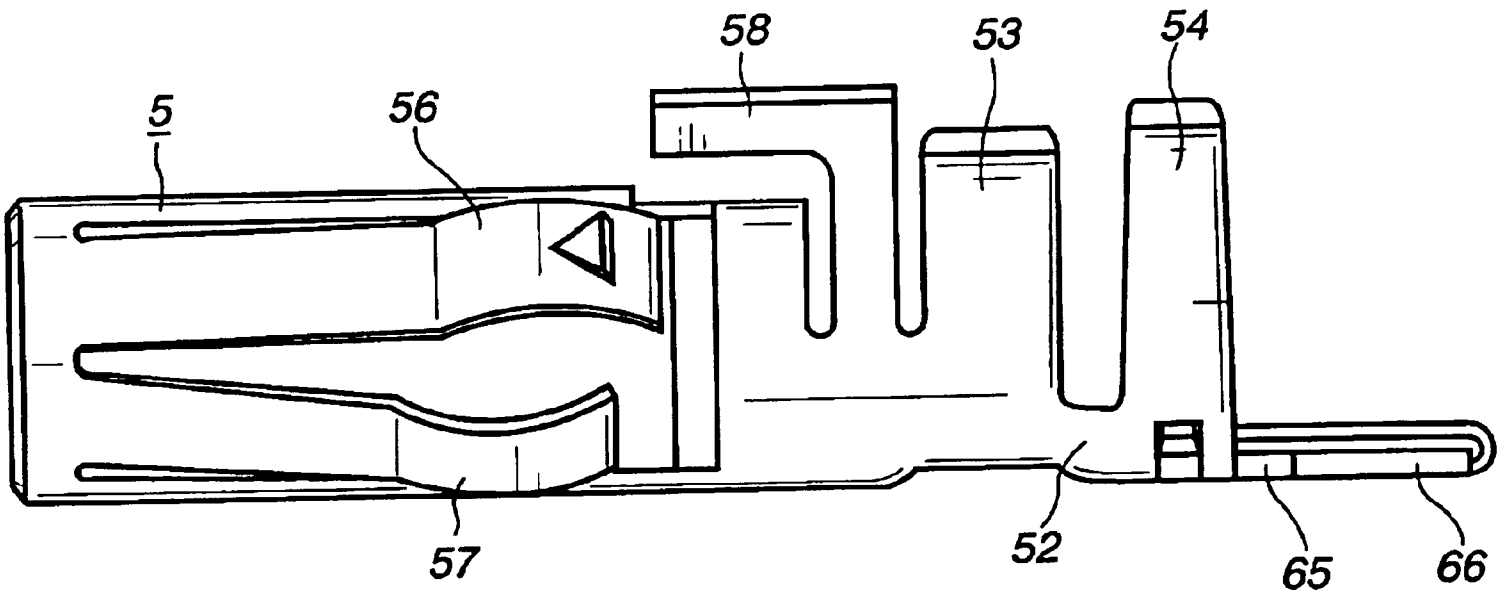
FIG. 23 is a bottom view of FIG. 22.
Figure 24:
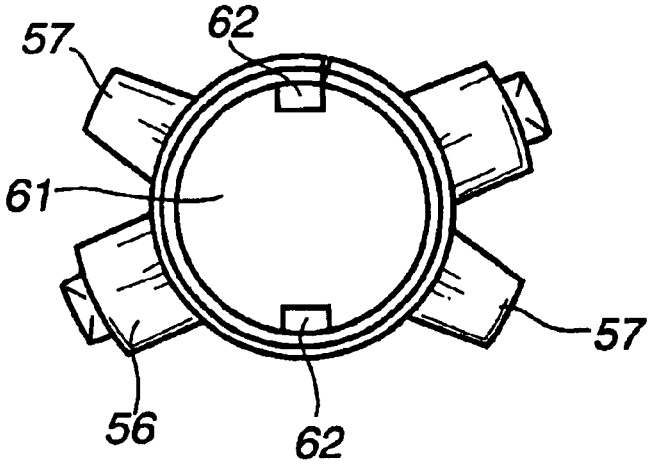
FIG. 24 is a left side view of FIG. 23.
Figure 25:
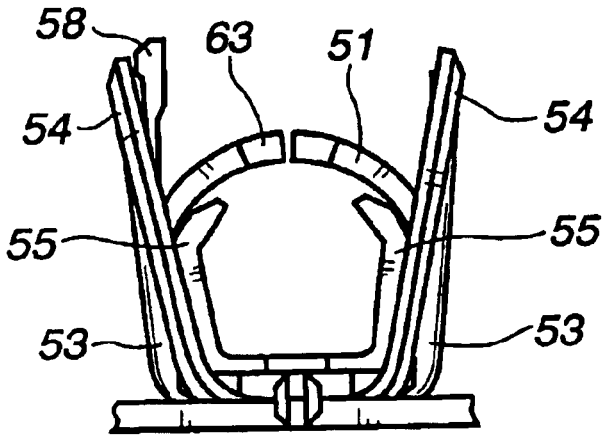
FIG. 25 is a right side view of FIG. 23.
Figure 26:
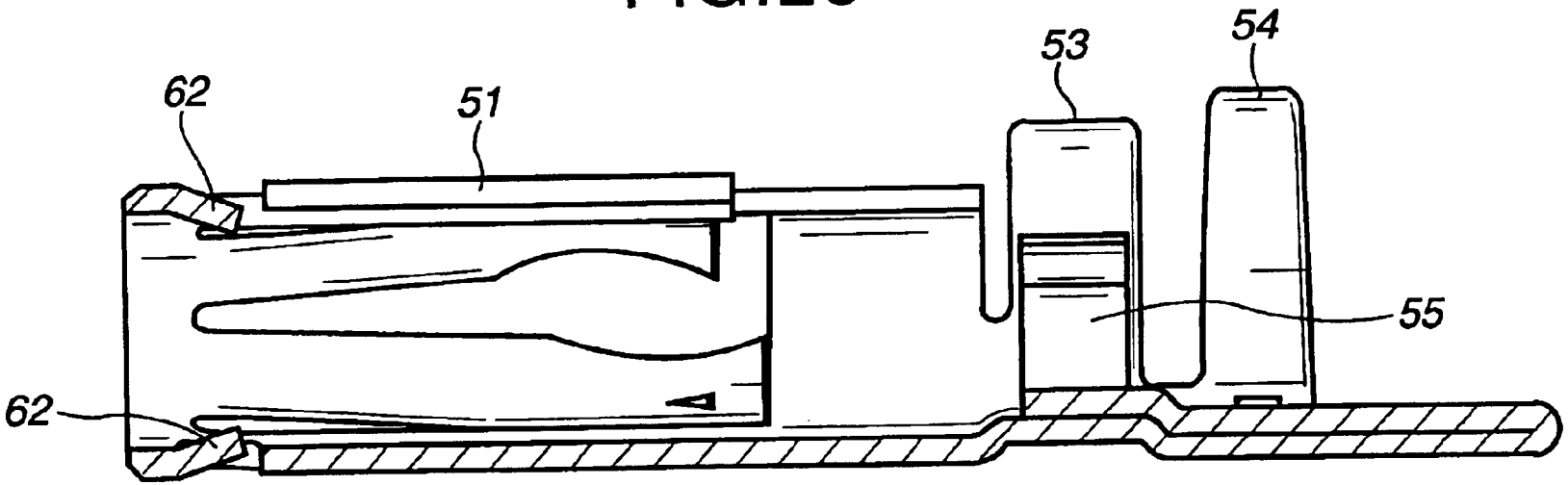
FIG. 26 is a sectional view taken on line XXVI—XXVI of FIG. 22.

As shown in FIGS. 13 and 14, the first and second engaging contact pieces 22, 23 are formed by bending a band-like piece inwards so that front ends of the bent portions engage each other. More specifically, the second engaging contact pieces 23 are formed in a bifurcated shape, while the first engaging contact piece 22 is formed in a shape capable of getting in between the bifurcated portions of the second engaging contact piece 23. In the vicinity of front ends of the second engaging contact pieces 23 there are formed, by bending, a pair of concaves 24 for positioning a central conductor 71 of a coaxial cable 7.

An insulating housing 3 is formed in a generally cylindrical shape by molding an insulating synthetic resin. As shown in FIGS. 16 to 21, a pin inserting hole 31 is formed through a central portion of the insulating housing 3, the pin inserting hole 31 being for press-fitting therein of the plug pin 1 axially of the insulating housing from a front end side (left side in FIG. 16) of the same housing. Further, a connecting notch 32 is formed in an upper wall portion of a base end side (right side in FIG. 16) of the insulating housing 3.

A pair of recesses 33 are formed in opposed right and left inner wall surface portions of the pin inserting hole 31. The recesses 33 are open on a base end side of the pin inserting hole 31, extend along a central axis of the pin inserting hole toward a front end side of the same hole, and reach a nearly central part.

An engaging rib 34, which is for engagement with the engaging notch 16 of the plug pin 1 to retain the retaining projections 17, is projected from an upper inner wall surface portion of the pin inserting hole 31. The engaging rib 34 is formed in the shape of an elongated rectangular parallelepiped extending along the central axis of the pin inserting hole 31 and its base end side faces the connecting notch 32.

On opposed right and left side wall portions of the insulating housing 3 there are formed, by cutting and opening, a pair of cantilevered retaining beams 35, the retaining beams 35 being connected on a stationary side thereof to bottom wall portions on front end sides of the recesses 33 and extending on a movable side thereof axially toward the front end side of the insulating housing 3. More specifically, in each retaining beam 35, an elongated slit 36 is formed in the side wall of the insulating housing 3, the slit 36 having a width equal to the width of each recess 33 and a length extending from an axial front end portion of the recess 33 up to near the front end portion of the insulating housing 3. Within the slit 36 is formed the associated retaining beam 35 in a cantilevered state so as to be connected on a stationary side thereof to the bottom wall portion on the front end side of the recess 33 and extend on movable side thereof toward a front end side of the slit 36.

An inside wall surface of each retaining beam 35 is formed nearly flush with the bottom surface of each recess 33, while an outside wall surface thereof is formed as a slant surface which leaves an outer periphery surface of the insulating housing 3 outwards as it approaches the front end side.

A pair of retaining pawls 37 projecting toward the pin inserting hole 31 are formed at front end portions of the retaining beams 35 in such a manner that their front end faces are substantially flush with the inner wall surface of the pin inserting hole 31.

A pair of protuberances 38 for stopper are formed on front end-side outer wall surfaces of opposed right and left side wall portions of the insulating housing 3.

Guide grooves 41 and 42 for guiding a pair of engaging lances 62 of the external contact 5 are formed axially on outer wall surfaces of opposed upper and lower side wall portions of the insulating housing 3. The guide grooves 41 and 42 extend from the base end side of the insulating housing 3 up to near the central part of the housing. A base end side of the upper guide groove 41 opens to the connecting notch 32, while a base end side of the lower guide groove 42 is open to an end face on the base end side of the insulating housing 3. Front end-side bottom surfaces of the guide grooves 41 and 42 approach the outer periphery surface of the insulating housing 3 as they approach the front end side and are each formed as a slant surface so as to match the outer periphery surface of the housing.

In front end-side outer wall surfaces of the opposed upper and lower side wall portions of the insulating housing 3 there are formed a pair of engaging grooves 43 which are open toward the front end faces of the side wall portions and which extend axially toward the base end side. Base ends of the engaging grooves 43 are formed as engaging stepped portions 44 adapted to engage with the engaging lances 62 of the external contact 5.

The external contact 5 is formed by punching and bending a conductive metallic sheet and, as shown in FIGS. 22 to 26, it comprises a contact body 51, a mounting plate 52, a pair of outer compression-bonding pieces 53, a pair of coating compression-bonding pieces 54, a pair of inner compression-bonding pieces 55, a pair of contact tongue pieces 56, a pair of contact tongue pieces 57, and a cover piece 58.

The contact body 51 is formed in a generally cylindrical shape, the mounting plate 52 is formed in a generally rectangular shape extending from an edge of the contact body 51 to a base end side (right side in FIG. 22) axially, the pair of outer compression-bonding pieces 53 and the pair of coating compression-bonding pieces 54 are erected on the mounting plate 52, and the pair of inner compression-bonding pieces 55 are erected on the mounting plate 52 while being positioned between the pair of outer compression-bonding pieces 53.

The pair of contact tongue pieces 56 and the pair of contact tongue pieces 57 are formed by cutting and raising opposed right and left peripheral wall portions of the contact body 51 from near a front end side (left side in FIG. 22), and the cover piece 58 is erected from a peripheral wall portion near the base end side of the contact body 51.

Centrally of the contact body 51 is formed a housing inserting hole 61 axially.

A pair of engaging lances 62 are formed on opposed upper and lower side wall portions on the front end side of the external contact 5, the engaging lances 62 being formed by cutting and raising a peripheral wall portion near the front end side and with front ends thereof projected inwards. A connecting notch 63 is formed in an upper wall on the base end side of the external contact 5.

In FIGS. 22 to 26, the numeral 65 denotes a connecting piece for connecting a corresponding each individual external contact 5 to a carrier 66. At the time of assembly, the external contact 5 is separated from the carrier 66 by cutting off the connecting piece 65.

Next, a method for assembling the connector shown in FIGS. 4 to 9 and a method for connecting the coaxial cable 7 to the connector will be described below with reference also to FIGS. 27A, 27B, 28A, and 28B.

A description will be given first about how to assemble the connector.

Figure 27A:
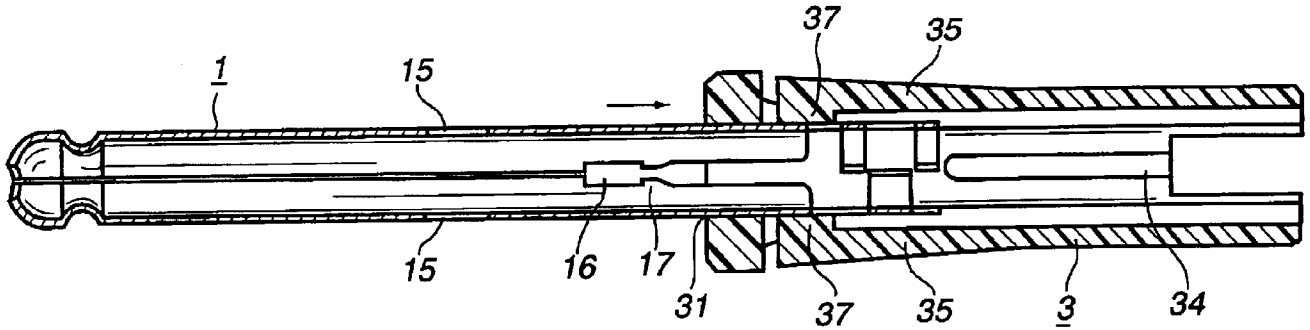
Figure 27B:
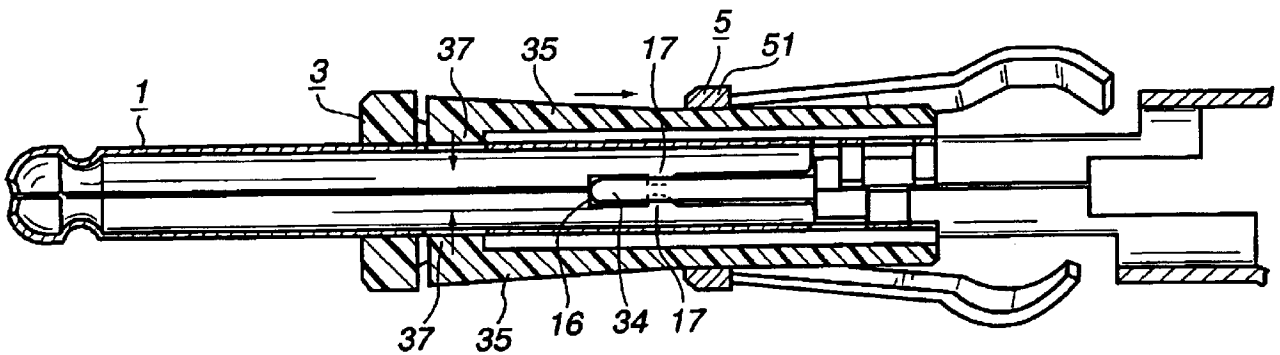

(1) As indicated with arrow in FIG. 27A, the plug pin 1 is press-fitted into the pin inserting hole 31 from the front end side of the insulating housing 3. At this time, the press-fitting is performed while aligning the engaging notch 16 of the plug pin 1 with the engaging rib 34 of the insulating housing 3. As shown in FIG. 27B, the front end portion of the engaging rib 34 comes into abutment against the front end face of the engaging notch 16 and is positioned thereby, further, the retaining projections 17 bite into engagement with the engaging rib 34, whereby the plug pin 1 is fixed inside the insulating housing 3.

Figure 6:
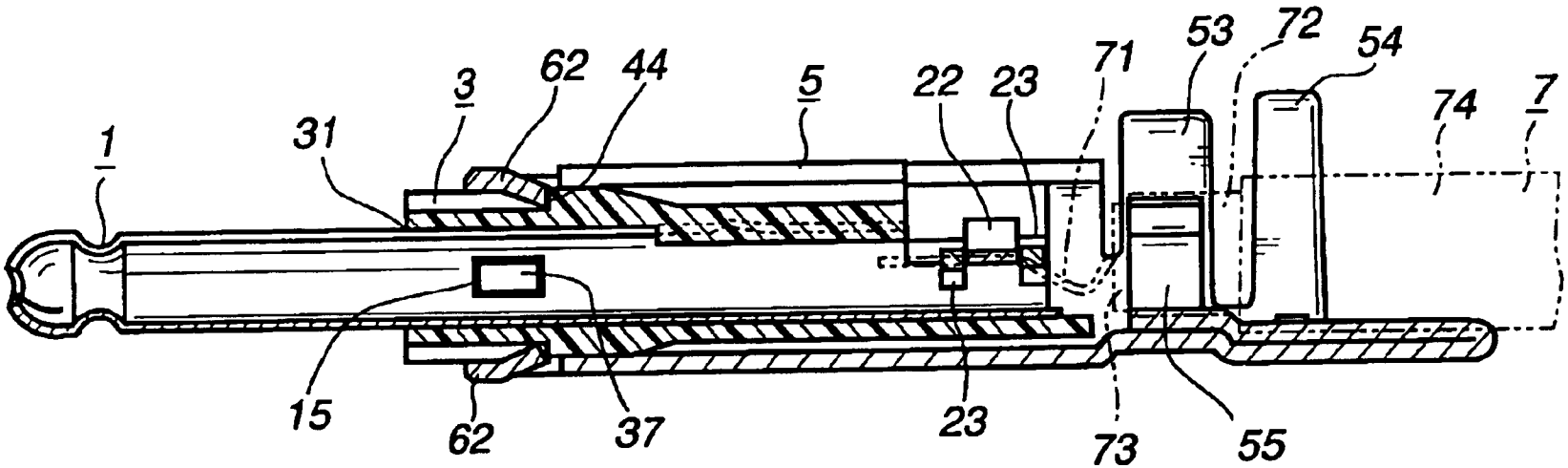
FIG. 6 is a sectional view taken on line VI—VI of FIG. 4.

(2) Next, as indicated with arrow in FIG. 27B, the assembly obtained in the above (1) is inserted into the external contact 5 from the front end side of the external contact while aligning the engaging lances 62 of the external contact 5 with the guide grooves 41 and 42 of the insulating housing 3. When the front ends of the engaging lances 62 get over the engaging stepped portions 44 of he insulating housing 3, the engaging lances 62 and the engaging stepped portions 44 come into engagement with each other, as shown in FIG. 6, and the front edge of the contact body 51 is put in abutment against the protuberances 38, as shown in FIG. 7, whereby the external contact 5 is fixed to the outside of the insulating housing 3.

Figure 7:
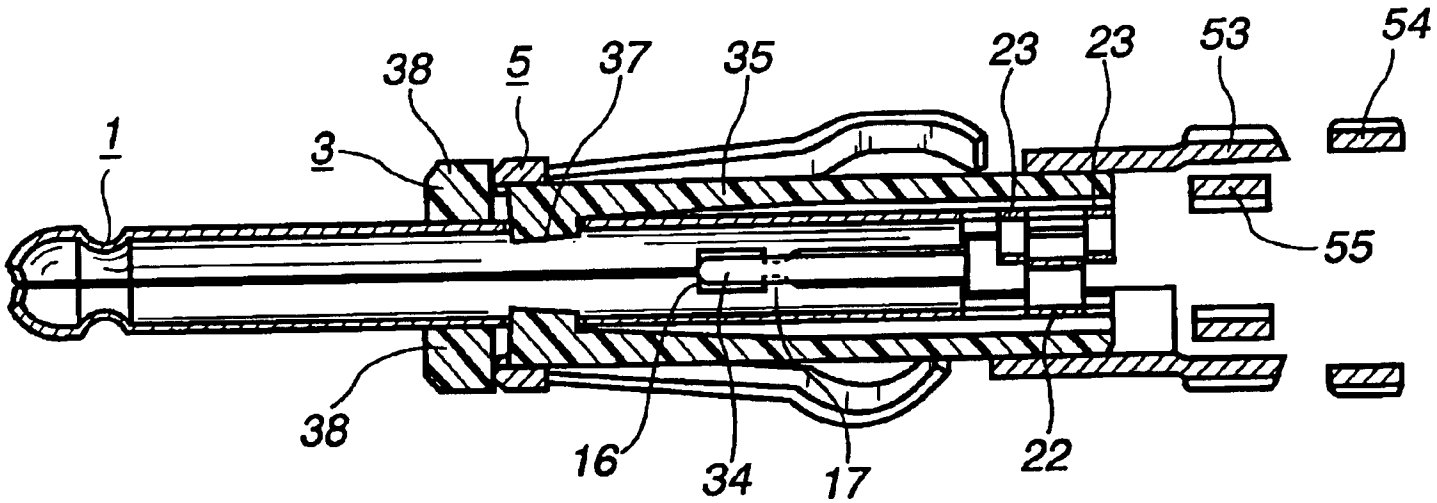
FIG. 7 is a sectional view taken on line VII—VII of FIG. 5.
Figure 8:
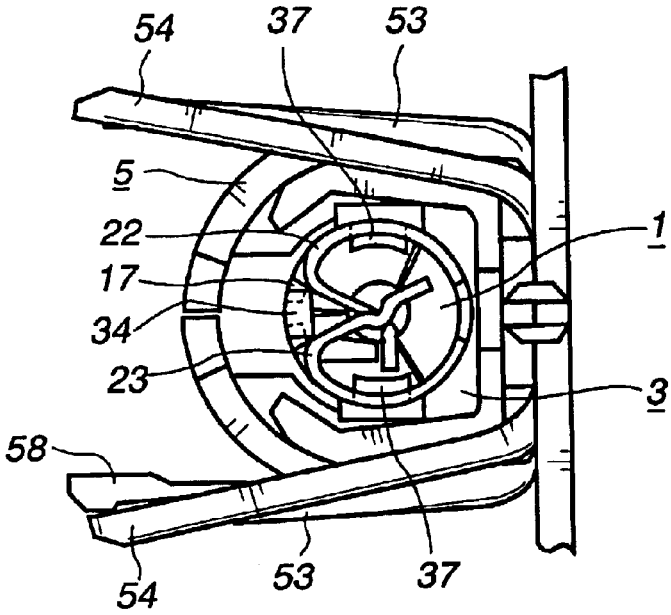
FIG. 8 is an enlarged right side view of FIG. 4.
Figure 9:
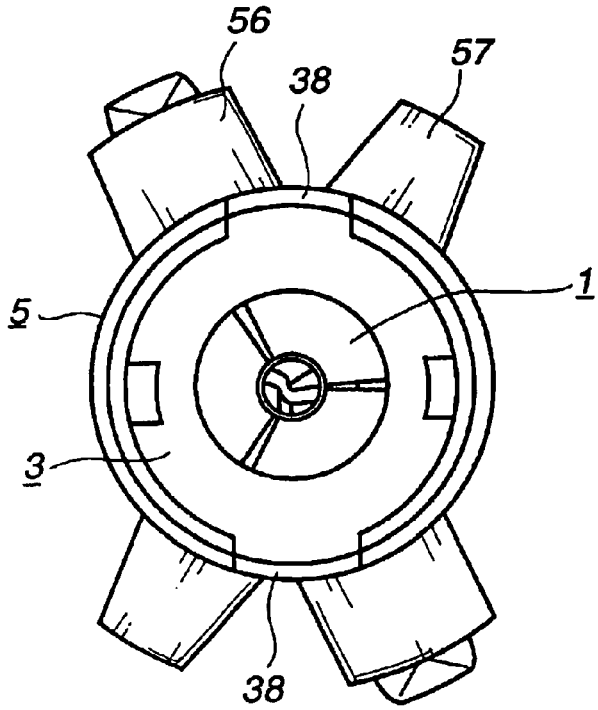
FIG. 9 is an enlarged left side view of FIG. 4.
Figure 10:
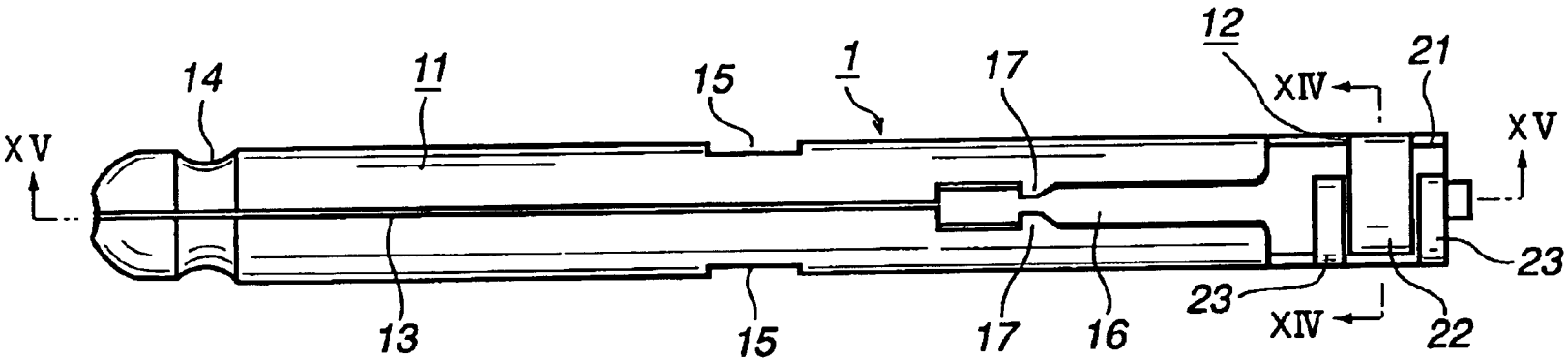
FIG. 10 is an enlarged front view of a plug pin 1 shown in FIGS. 4 to 9.
Figure 11:
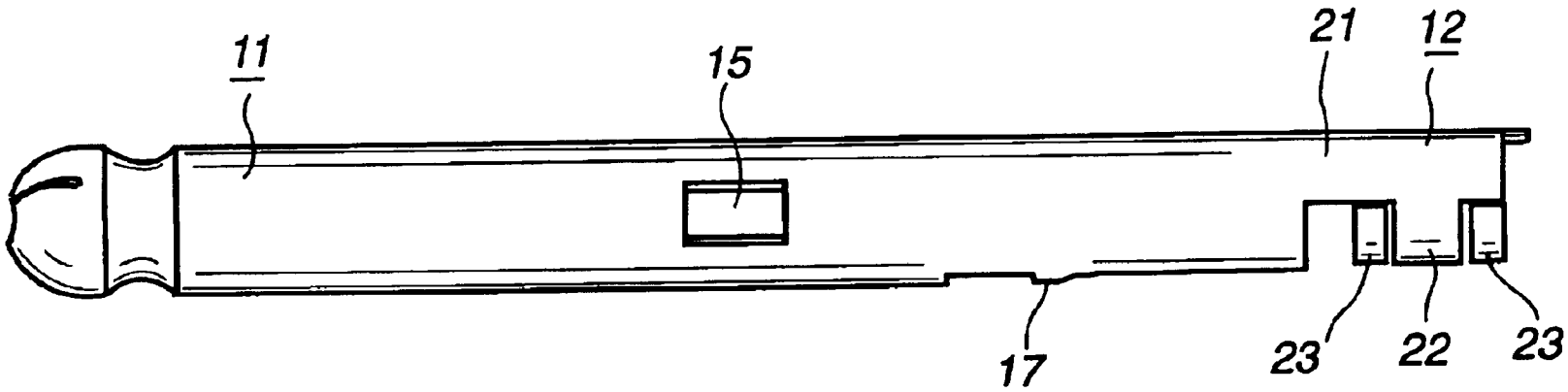
FIG. 11 is a plan view of FIG. 10.
Figure 12:
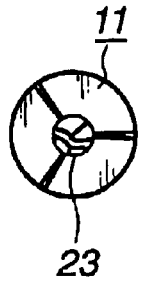
FIG. 12 is a left side view of FIG. 10.

Further, by inserting the assembly obtained in the above (1) into the external contact 5, the inner wall of the contact body 51 of the external contact 5 pushes the retaining beams 35, so that the retaining pawls 37 of the retaining beams 35 move from outside to inside as indicated with arrow in FIG. 27B and come into engagement with the engaging holes 15 of the plug pin 1 as in FIG. 7, whereby the plug pin 1 is fixed to the inside of the insulating housing 3.

(3) As described in the above (1) and (2), the fixing of the plug pin 1 to the insulating housing 3 is done by press-fitting the plug pin 1 into the insulating housing 3, thereby making the retaining projections 17 bite into engagement with the engaging rib 34, and by inserting the insulating housing 3 into the external contact 5 to let the retaining pawls 37 engage with the engaging holes 15. Thus, the fixing strength can be enhanced in a well-balanced state as compared with the prior art wherein the fixing is done by only press-fitting.

Besides, the engaging rib 34 is projected from the inner wall surface of the pin inserting hole 31 in the insulating housing 3 at a position substantially equidistant from the retaining beams 35, the engaging notch 16 is formed in the central contact 1 for engagement with the engaging rib 34 at the time of press-fitting of the plug pin into the pin inserting hole 31, and the retaining projections 17 are projected from the engaging notch 16 so as to bite into engagement with the engaging rib 34 upon press-fit of the plug pin into the pin inserting hole 31. According to this construction, the fixing strength between the central contact 1 and the insulating housing 3 can be further enhanced in a well-balanced state without making the structure of the central contact 1 and that of the insulating housing 3 so complicated.

Moreover, as shown in FIG. 6, since the mutual fixing of the insulating housing 3 and the external contact 5 is done by engaging the pair of engaging lances 62 with the corresponding engaging stepped portions 44, the fixing strength between the insulating housing 3 and the external contact 5 can be enhanced in a well-balanced state as compared with the prior art wherein the fixing is done by engagement of a single engaging lance with a corresponding engaging stepped portion.

Next, the following description is provided about a method of connecting the coaxial cable 7 to the connector.

(1) The coaxial cable 7 with braided conductor 73 and central conductor 71 both exposed in advance is inserted into the external contact 5 from the base end side of the external contact until the central conductor 71 is positioned above the engaged portion of the first and second engaging contact pieces 22, 23.

Figure 28A:
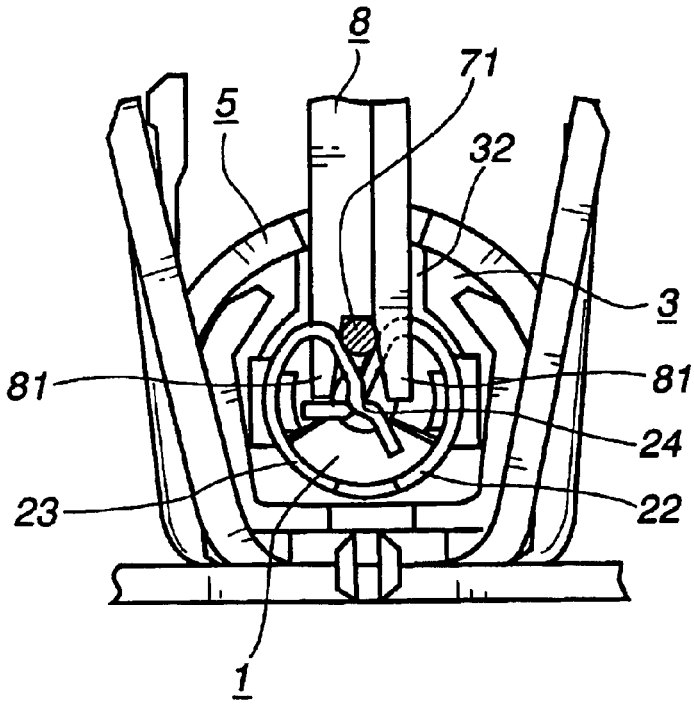

(2) Next, as shown in FIG. 28A, the central conductor 71 is positioned between a pair of pressing projections 81 of a jig 8 which is inserted through the connecting notch 32 in the insulating housing 3, and the jig 8 is pushed down. As a result, the first and second engaging contact pieces 22, 23 are expanded by the pressing projections 81 and the central conductor 71 is pushed down and is conducted up to the concaves 24 formed in the second engaging contact pieces 23.

Figure 28B:
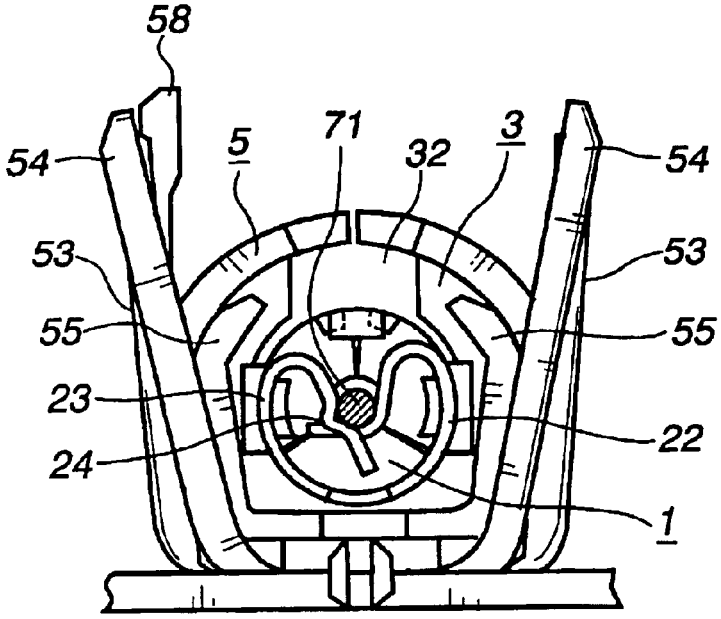

(3) Then, when the jig 8 is removed upwards, the first and second engaging contact pieces 22, 23 tend to revert to their original state by virtue of their own elasticity and, as shown in FIG. 28B, the central conductor 71 which has been conducted to the concaves 24 is held grippingly by the first and second engaging contact pieces 22, 23 and connects to the plug pin 1 electrically.

(4) Next, the inner compression-bonding pieces 55 of the external contact 5 are inserted between an internal insulator 72 and the braided conductor 73 of the coaxial cable 7 and in this state the outer compression-bonding pieces 53 are caulked, whereby the braided conductor 73 of the coaxial cable 7 and the external contact 5 are fixed and electrically connected together.

Then, the coating compression-bonding pieces 54 of the external contact 5 are caulked on an insulating coating 74 of the coaxial cable 7, whereby the whole of the connecting-side end portion of the coaxial cable 7 is fixed to the external contact 5.

(5) Next, the connecting piece 65 of the external contact 5 is cut off and separated from the carrier 66 at a base end-side position of the coating compression-bonding pieces 54, then the cover piece 58 is bent inwards to cover the connecting portion 12 from above and the plug pin 1 is shut off from the exterior to prevent the entry of unnecessary radiation and extraneous noise.

(6) In the manner described in the above (1) to (5) the connector connected to the coaxial cable 7 is fitted with a mating connector (e.g., an automobile antenna socket), whereby the plug pin 1 comes into contact with a signal terminal of the mating connector and the external contact 5 connects to an earth terminal of the mating connector, providing an electric connection.

In the above embodiment, for enhancing the fixing strength between the insulating housing 3 and the external contact 5 in a well-balanced state without making the structure of the insulating housing and that of the external contact so complicated, a pair of engaging lances 62 are formed on opposed side wall portions of the external contact 5 and a pair of engaging stepped portions 44 are formed on the side wall of the insulating housing 3 for engagement with the engaging lances 62 at the time of insertion of the insulating housing into the external contact 5. However, the present invention is not limited to this construction, but is also applicable to the case where one engaging lance 62 is formed on the side wall of the external contact 5 and one engaging stepped portion 44 is formed on the side wall of the insulating housing 3 for engagement with the engaging lance 62 at the time of insertion of the insulating housing into the external contact 5.

In the above embodiment, for enhancing the fixing strength between the plug pin 1 and the insulating housing 3 in a well-balanced state without making the structure of the plug pin and that of the insulating housing so complicated, an engaging rib 34 is projected from an upper portion of the inner wall surface of the pin inserting hole 31 and retaining beams 35 are formed on opposed right and left side wall portions of the insulating housing 3, the engaging rib 34 being positioned substantially equidistantly from the pair of retaining beams 35, further, a retaining notch 16 and retaining projections 17 are formed in the plug pin 1, the engaging notch 16 being engaged with the engaging rib 34 and the retaining projections 17 being engaged with the engaging notch 16. However, the present invention is not limited to this construction, but is also applicable to the case where the engaging rib 34 is not positioned equidistantly from the pair of retaining beams 35 and/or the case where the engaging notch 16 and the retaining projections 17 are not formed in the plug pin 1.

For example, the present invention is also applicable to the case where retaining projections are formed on the plug pin 1 by cutting the plug pin and raising the cut portion and are allowed to bite into engagement with the inner wall surface of the pin inserting hole 31 to fix the plug pin when the plug pin is press-fitted into the insulating housing 3.

In the above embodiment, for enhancing the fixing strength between the plug pin 1 and the insulating housing 3 in a well-balanced state without making the structure of the plug pin 1 and that of the insulating housing 3 so complicated, a pair of engaging holes 15 are formed in opposed side wall portions of the plug pin 1, a pair of retaining beams 35 are formed in opposed side wall portions of the insulating housing 3 correspondingly to the engaging holes 15, and a pair of retaining pawls 37 are projected from the front ends of the retaining beams 35 toward the pin inserting holes 31. However, the present invention is not limited to this construction, but is also applicable to the case where one or three or more engaging holes are formed in the side wall of the plug pin 1, one or three or more cantilevered retaining beams are formed on the side wall of the insulating housing 3, the retaining beams being pushed by the external contact 5 and moving toward the pin inserting hole 31 upon insertion of the insulating housing 3 into the external contact 5, and one or three or more retaining pawls are formed in portions of the retaining beams so as to engage with the engaging hole or holes upon movement of the retaining beam or beams toward the pin inserting hole 31.

Although in the above embodiment the present invention is applied to a standard type connector (e.g., a connector connected to a relatively thick coaxial cable) in which a base-end outer periphery portion of a semispherical front end of a plug pin is formed in the shape of an annular recess, the present invention is not limited thereto, but is also applicable to a connector (e.g., a connector connected to such a relatively thin coaxial cable as shown in FIG. 1A) in which a base-end outer periphery portion of a semispherical front end of a plug pin is not in the shape of an annular recess.

What is claimed is:

1. A connector comprising a central contact (1), an insulating housing (3) having a contact inserting hole (31) for press-fit therein of the central contact (1), and an external contact (5) adapted to engage with the insulating housing (3) by insertion therein of the insulating housing (3) with the central contact (1) press-fitted therein, the insulating housing (3) being formed in a generally cylindrical shape, characterized in that an engaging hole is formed in a side wall of the central contact (1), a cantilevered retaining beam is formed on a side wall of the insulating housing (3), said retaining beam being pressed by the external contact (5) and moving toward the contact inserting hole (31) upon insertion of the insulating housing (3) into the external contact (5), and a retaining pawl is formed in part of said retaining beam so as to engage with said engaging hole upon movement of the retaining beam toward the contact inserting hole (31);

wherein said engaging hole comprises a pair of engaging holes (15, 15) formed in opposed side wall portions of the central contact (1), said retaining beam comprises a pair of retaining beams (35, 35) formed on opposed side wall portions of the insulating housing (3), and said retaining pawl comprises a pair of retaining pawls (37, 37) projecting from front ends of the retaining beams (35, 35) toward the contact inserting hole (31).

2. A connector according to claim 1, wherein a pair of engaging lances (62, 62) are formed by cutting opposed side wall portions of the external contact (5) and raising the cut portions, and a pair of engaging stepped portions (44, 44) are formed on the side wall of the insulating housing (3), the pair of engaging stepped portions (44, 44) coming into engagement with the engaging lances (62, 62) when the insulating housing (3) is inserted into the external contact (5).

3. A connector according to claim 1 wherein a pair of engaging lances (62, 62) are formed by cutting opposed side wall portions of the external contact (5) and raising the cut portions, and a pair of engaging stepped portions (44, 44) are formed on the side wall of the insulating housing (3), the pair of engaging stepped portions (44, 44) coming into engagement with the engaging lances (62, 62) when the insulating housing (3) is inserted into the external contact (5).

4. A connector according to claim 1, wherein an elongated engaging rib (34) of a rectangular parallelepiped shape is projected from an inner wall surface of the contact inserting hole (31) along a central axis of the contact insertion hole, said inner wall surface being positioned nearly equidistantly from the pair of retaining beams (35, 35), an engaging notch (16) is formed on a base end side of the central contact (1), the engaging notch (16) coming into engagement with the engaging rib (34) when the central contact (1) is press-fitted into the contact inserting hole (31), and retaining projections (17, 17) are formed on opposed inside edge portions of the engaging notch (16), the retaining projections (17, 17) being adapted to bite into engagement with the engaging rib (34) upon press-fit of the central contact (I) into the contact inserting hole (31).

5. A connector according to claim 4, wherein a pair of engaging lances (62, 62) are formed by cutting opposed side wall portions of the external contact (5) and raising the cut portions, and a pair of engaging stepped portions (44, 44) are formed on the side wall of the insulating housing (3), the pair of engaging stepped portions (44, 44) coming into engagement with the engaging lances (62, 62) when the insulating housing (3) is inserted into the external contact (5).

* * * * *